United States Patent [19]

Mochizuki et al.

[11] 4,122,688

[45] Oct. 31, 1978

[54] REFRIGERATING SYSTEM

[75] Inventors: Taketoshi Mochizuki; Fumio Harada; Tadahiro Imaizumi, all of Shimizu; Koichi Nose, Ashiya, all of Japan

[73] Assignees: Hitachi, Ltd.; Shin Meiwa Industry Co., Ltd., both of Japan

[21] Appl. No.: 816,938

[22] Filed: Jul. 19, 1977

[30] Foreign Application Priority Data

| | | | |
|---|---|---|---|
| Jul. 30, 1976 | [JP] | Japan | 51-90338 |
| Jul. 30, 1976 | [JP] | Japan | 51-90340 |
| Mar. 23, 1977 | [JP] | Japan | 52-34423[U] |

[51] Int. Cl.[2] ..... F25B 41/00; F25B 47/00

[52] U.S. Cl. ..... 62/196 R; 62/278

[58] Field of Search ..... 62/196 A, 196 B, 196 C, 62/196 R, 278, 442

[56] References Cited

U.S. PATENT DOCUMENTS

| | | | |
|---|---|---|---|
| 3,138,007 | 6/1964 | Friedman et al. | 62/278 |
| 3,150,498 | 9/1964 | Blake et al. | 62/81 |
| 3,316,731 | 5/1967 | Quick | 62/278 |
| 3,343,375 | 9/1967 | Quick | 62/81 |
| 3,358,469 | 12/1967 | Quick | 62/196 A |
| 3,427,819 | 2/1969 | Seghetti | 62/278 |
| 3,464,226 | 9/1969 | Kramer | 62/196 R |
| 3,633,378 | 1/1972 | Toth | 62/278 |
| 3,638,444 | 2/1972 | Lindahl | 62/278 |
| 3,645,109 | 2/1972 | Quick | 62/278 |
| 3,664,150 | 5/1972 | Patterson | 62/278 |

*Primary Examiner*—Lloyd L. King

*Attorney, Agent, or Firm*—Craig & Antonelli

[57] ABSTRACT

A refrigerating system having, arranged to form a closed circuit, a refrigerant compressor, a condensor, a receiver and a plurality of sets of evaporators and expansion valves with all the sets connected in parallel with one another. The system further includes a throttle mounted in the circuit between the condenser and the receiver, a branch line and change-over valves for selectively connecting the circuit on the delivery side of the compressor to each evaporator and a passage connecting each evaporator to the receiver by bypassing the associated expansion valve, so that the refrigerantin the state of a compressed gas can be supplied to a desired evaporator to defrost the same and the refrigerant condensed in the defrosted evaporator can be returned to the receiver. The system further includes a bypass line having a throttle, connecting a gas compartment in the upper portion of the receiver to a line on the suction side of the compressor, for returning to the line on the suction side of the compressor, flash gas incorporated in the liquid refrigerant returned from the defrosted evaporator to the receiver.

18 Claims, 8 Drawing Figures

REFRIGERATING SYSTEM

LIST OF PRIOR ART REFERENCES (37 CFR 1.56(a))

The following references are cited to show the state of the art: U.S. Pat. Nos.

3,150,498
3,343,375
3,427,819
3,645,109

BACKGROUND OF THE INVENTION

This invention relates to refrigerating systems having a plurality of evaporators and formed as a refrigerant circuit of the refrigerant compression type, and more particularly to a refrigerating system of the type described which makes it possible to effect defrosting of any evaporator as desired with high efficiency when frost is formed on the surfaces of the evaporators as a refrigerating operation is performed.

A refrigerating system of the compression type having a refrigerant compressor, a condenser, a plurality of evaporators and a plurality of expansion valves each belonging to one of the evaporators is generally formed as a closed circuit in which a refrigerant (R-12, R-22 or R-502) is sealed. This type is refrigerating system develops frost formation in the evaporators as a refrigerating operation is performed. Heavy frost formation lowers the refrigerating ability of the system, so that it is necessary to effect defrosting depending on the degree of frost formation on the surfaces of the evaporators.

The refrigerating system in which the present invention can be incorporated is mainly of the type which is used as a refrigerating system for supermarkets and the like. In this type of refrigerating system, a condensing unit consisting of one or a plurality of compressors has connected thereto a plurality of evaporator units (mounted in show-cases of a store).

When a defrosting operation is performed in this type of refrigerating system, defrosting may be effected with a single evaporator as a unit and the rest of the evaporators perform a refrigerating operation. Alternatively, a plurality of evaporators may be formed into a block in a refrigerant circuit, and the evaporators belonging to this block may be subjected to defrosting as a unit, with the evaporators belonging to other blocks continuing in refrigerating operation.

In the description set forth hereinafter and in the claims, the term "unit evaporator means" is used which refers to the unit of an evaporator or evaporators in which defrosting is effected when the system is operated for performing defrosting. Therefore, the term should be understood to include either a single evaporator or a plurality of evaporators belonging to a unit block.

In one type of refrigerating system known in the art which effects defrosting of the evaporators in accordance with the aforesaid principle, a refrigerant circuit is formed in which a branch line is connected at one end thereof to the high pressure gas refrigerant outlet passage between the refrigerant compressor (hereinafter referred to as a compressor) and the condenser for taking out a high pressure gas refrigerant for effecting defrosting, each unit evaporator means is connected at the compressor side thereof either to the suction side of the compressor or to the other end of the branch line by switching from one to the other by means of flow passage change-over valves, and a parallel circuit of an electromagnetic valve and a check valve is suitably connected through the expansion valve side passage of each unit evaporator means to the receiver through a throttle. When all the unit evaporator means operate to effect refrigeration (hereinafter referred to as a refrigerating mode), the compressor side of each unit evaporator means is connected to the suction side of the compressor through the associate flow passage changeover valve to function as an ordinary refrigerant circuit. When unit evaporator means of any number as desired of all the unit evaportor means are subjected to defrosting while the rest of the unit evaporator means perform a refrigerating operation (hereinafter referred to as a defrosting mode), the flow passage change-over valves of the unit evaporator means to be defrosted are actuated to connect the same to the branch line, so that a portion of the high pressure gas refrigerant exhausted from the compressor is passed to such unit evaporator means to effect defrosting thereof while the rest of the unit evaporator means continue to perform a refrigerating operation.

The refrigerating system which effects defrosting of the evaporators in accordance with the aforesaid principle is required to satisfy the following requirements. Such system should be able to positively produce a refrigerant in a gaseous state of high pressure which enables defrosting to be effected when the system operates in the defrosting mode. The flow of the refrigerant in a gaseous state of high pressure used for defrosting to the unit evaporator means to be defrosted should be promoted. The efficiency with which defrosting is effected should be increased. And the supply of refrigerant to the rest of the unit evaporator means should be ensured so as to enable such evaporators to perform a refrigerating operation by feeding a sufficiently high flow rate of refrigerant to prevent a reduction in refrigerating efficiency.

This type of refrigerating system is disclosed in U.S. Pat. Nos. 3,150,498, 3,343,375, 3,427,819 and 3,645,109.

The system disclosed in U.S. Pat. No. 3,150,498 is characterized by the provision of a throttle valve mounted between the condenser and the receiver for causing the defrosting high pressure gas to flow, so as to enable the condensate produced as the result of defrosting to be recovered and collected in the receiver.

U.S. Pat. No. 3,343,375 is directed to a system which is characterized in that a liquid conduit from the liquid line is inserted in a branch line connected to the outlet passage of the compressor to enable the refrigerant in a liquid state from the liquid line to be sucked by the Venturi effect into a refrigerant in a gaseous state of high pressure for effecting defrosting which is taken out through the branch line, so as to bring the refrigerant in a gaseous state of high pressure to a state of a gas of high pressure which is almost saturated.

In U.S. Pat. No. 3,427,819, there is disclosed a system having a feature in the manner of production of the refrigerant in a gaseous state of high pressure, in which system the gas of high pressure almost saturated which is taken out from the upper portion of the receiver is used as the refrigerant in a gaseous state of high pressure for effecting defrosting.

The system disclosed in U.S. Pat. No. 3,645,109 is characterized in that a throttle is provided downstream of the receiver for imparting differential pressure to the flow of the refrigerant in a gaseous state of high pressure for effecting defrosting by the action of the throttle, and the refrigerant in a gaseous state is drawn toward the suction side of the compressor through a float switch from the header for the evaporators or from the upper portion of a vessel mounted independently of the receiver, so that the refrigerant in the liquid state condensed by the defrosting action can be introduced into the header or the vessel.

In the aforesaid system, the refrigerant which has been changed from the gaseous state to the liquid state by condensation as the result of a defrosting operation is caused to flow into the header for the evaporators or the reservoir vessel mounted independently of the receiver. In such system, it is necessary to provide a space of a large area for storing the gaseous refrigerant in order to positively separate the gaseous phase from the liquid phase in the refrigerant introduced into the header or the reservoir vessel, so that only the flash gas can be made to flow to the suction side of the compressor.

SUMMARY OF THE INVENTION

An object of the present invention is to provide a refrigerating system in which a reservoir of a large volume for a condensate directly connected to the condenser is utilized for quickly recovering to such reservoir the refrigerant in the liquid state obtained by condensation as the result of a defrosting operation, so that flash gas can be positively separated from the liquid refrigerant and only such gas can be passed on to the suction side of the compressor.

Another object is to provide a refrigerating system in which the refrigerant in the liquid state obtained by condensation and having flash gas removed therefrom is fed to the rest of the unit evaporator means continuing to perform a refrigerating operation.

Another object is to provide a refrigerating system in which the suction pressure of the refrigerating system operating in the defrosting mode can be increased by positively passing the flash gas on to the suction side of the compressor, whereby the production of high pressure gas providing a driving force for effecting defrosting can be promoted and the efficiency with which defrosting is effected can be increased.

Another object is to provide a refrigerating system in which pressure differential is positively created between a branch line for taking out the high pressure gas for effecting defrosting and the reservoir for the condensate, so as to facilitate the outflow of the liquid refrigerant condensed in the unit evaporator means as the result of a defrosting operation and to enable defrosting to be effected in a short period of time.

Another object is to provide a refrigerating system, simple in construction and reliable in performance, which can operate in a defrosting mode on the basis of the defrosting principle stated in the aforesaid objects.

Still another object is to provide a refrigerating system in which the high pressure gas for effecting defrosting is led in the form of a substantially saturated gas of a relatively low temperature to the unit evaporator means in which defrosting is desired to be effected, so that heat distortion and sublimation of the frost can be prevented.

Still another object is to provide a refrigerating system in which only the refrigerant in the liquid state containing no flash gas is fed to the unit evaporator means performing a refrigerating operation when the system operates in the defrosting mode, whereby the refrigerating ability of the unit evaporator means operating to perform refrigeration can be positively maintained at a desired level.

In order to accomplish the aforementioned objects, it is proposed in the present invention to provide in the inflow passage of the reservoir for the condensate a throttle for the main refrigerant circuit, and to provide a bypass line having mounted therein another throttle and connecting the gas space in the upper portion of the reservoir for the condensate to the suction side of the compressor. It is also proposed to connect the expansion valves for the unit evaporator means to the reservoir for the condensate in a manner to produce no reduction of pressure in the refrigerant, and to provide a branch line connected to a line connecting the outlet side of the compressor to the throttle for the main refrigerant circuit, to take out the refrigerant gas of high pressure for effecting defrosting. While the system operates in the defrosting mode, the compressor side of the unit evaporator means in which defrosting is desired to be performed is connected through the agency of a flow passage change-over valve to the branch line and the expansion valve side of such unit evaporator means is connected to the reservoir for the condensate through a passage which bypasses the associated expansion valve, while the throttle in the bypass line is moved to an open position.

Generally, the reservoir for the condensate connected to the condenser has a space which is large enough in volume to receive gas therein even if all the refrigerant in the refrigerant circuit is contained in such reservoir. Thus, by connecting the expansion valve side of each unit evaporator means to the condensate reservoir in a manner to produce no reduction in pressure and by connecting the gas space in the upper part of the condensate reservoir to the suction side of the compressor through the bypass line mounting therein the throttle, it is possible to introduce quickly the liquid refrigerant obtained by condensation as the result of defrosting into the condensate reservoir of a large volume. At the same time, since the reservoir has a large volume, the flash gas in the reservoir can be positively separated from the liquid phase and collected in the upper portion of the reservoir. Since the space for collecting gas therein is also large in volume, it is possible to positively draw only the gas to the suction side of the compressor from the top of the gas space without the liquid refrigerant being incorporated in the gas.

By the aforementioned operation of the system, the suction pressure of the refrigerating system operating in the defrosting mode is increased, thereby promoting the production of the high pressure refrigerant gas which provides a driving force for effecting defrosting and increasing the efficiency with which defrosting is effected. Since the refrigerant in the liquid state from which the flash gas has been removed is supplied to the rest of the unit evaporator means performing a refrigerating operation, the refrigerating ability of the unit evaporator means performing refrigeration can be maintained at a desired level without showing a reduction.

The provision of the throttle for the main refrigerant circuit in the inflow line of the reservoir for the condensate makes it possible to provide pressure differential between the high pressure gas refrigerant taken out through the branch line and the reservoir for the condensate. Thus the refrigerant in the liquid state obtained by condensation of gas refrigerant in the unit evaporator means readily flows into the reservoir and the flow of the high pressure gas refrigerant for effecting defrosting is promoted, thereby making it possible to expedite the defrosting operation.

The use of the reservoir for the condensate of the main refrigerant circuit as a vessel for collecting the liquid refrigerant obtained by condensation of gas refrigerant as the result of the defrosting operation eliminates the need to use an auxiliary liquid collecting reservoir vessel and a float switch, etc. which are necessary for effecting degassing in conformity with the liquid level of the auxiliary vessel. Thus the refrigerating system is simple in construction and yet able to attain the objects of the invention.

In one mode of working the invention, if the refrigerating system is of the type which is provided with a receiver mounted in the main refrigerant circuit, the receiver functions as the reservoir for the condensate connected to the condenser, and the throttle is interposed between the condenser and the receiver.

In case the refrigerating system is of the type which has, for example, a condenser of the water-cooled type and therefore has no receiver mounted in the main refrigerant circuit, the reservoir for the condensate is formed in the condenser itself, and the throttle is naturally mounted in the inflow line of the condenser.

The throttle for the main refrigerant circuit may be in the form of an electromagnetic valve, a high pressure control valve, a float valve, a parallel circuit of an electromagnetic valve and a capillary tube, or a parallel circuit of a high pressure control valve. The throttle for the bypass line may be in the form of an electromagnetic valve, a series circuit of an electromagnetic valve and a capillary tube, or a series circuit of an electromagnetic valve and a suction pressure control valve. Any suitable type of throttle may be used depending on the construction of the refrigerant circuit.

In another mode of working the invention, if the throttle for the main refrigerant circuit is interposed between the condenser of the water-cooled type and the receiver, the branch line is connected to the main refrigerant circuit in a position which is located above the condenser of the water cooled type and as much remote as possible from the connection to the outlet pipe.

In still another mode of working the invention, the bypass line and the branch line may be arranged in a manner to effect heat exchange therebetween, so that the high pressure gas refrigerant for effecting defrosting can be passed in the form of a gas refrigerant of a relatively low temperature to the unit evaporator means in which defrosting is desired to be effected. This enables local heat distortion of the unit evaporator means and sublimation of the frost to be prevented.

When the bypass line and the branch line are arranged in heat exchanging relationship as aforesaid, portions of the lines of a suitable length may brought into contact with each other or the two lines may be formed as a heat exchanger of the double-tube type.

In a further mode of working the invention, the fluid passage connecting the expansion valves to the reservoir for the condensate may be divided into two fluid passages, one for feeding the refrigerant to the unit evaporator means performing a refrigerating operation and the other for returning and collecting the liquid refrigerant, obtained by condensation due to the defrosting action, in the reservoir for the condensate (receiver or condenser). By this arrangement the liquid refrigerant obtained by condensation due to the defrosting operation is positively returned to the reservoir for the condensate, and the flash gas in the liquid phase of the refrigerant is positively separated from the liquid phase to be released to the suction side of the compressor, thereby increasing the efficiency with which defrosting is effected while maintaining the refrigerating ability of the rest of the unit evaporator means performing a refrigerating operation at a desired level.

DESCRIPTION OF THE PREFERRED EMBODIMENTS

Figure 1:
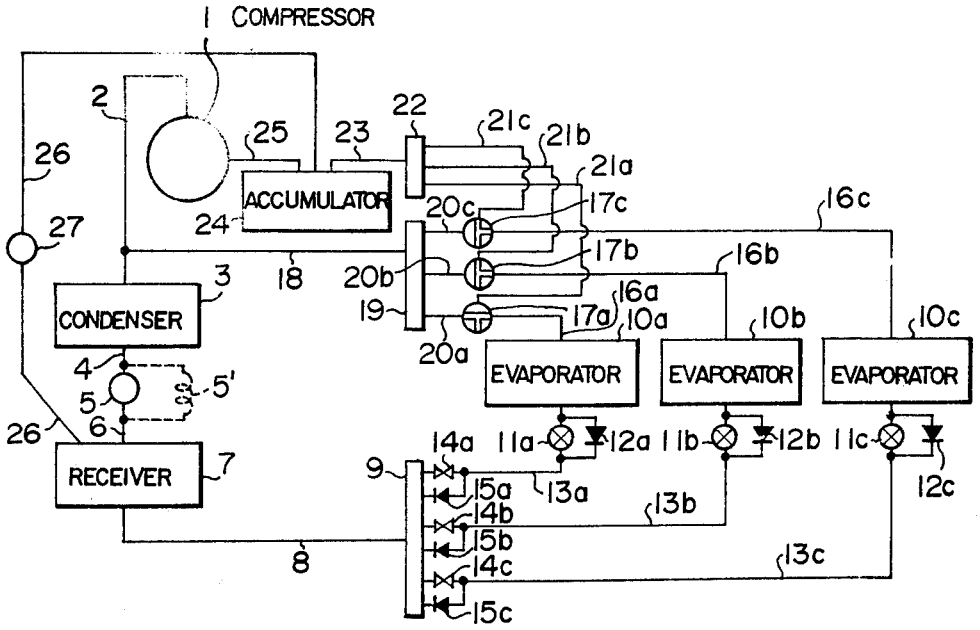
FIG. 1 is a diagram showing the refrigerant circuit of a refrigerating system including a plurality of evaporators and a receiver, which system comprises one embodiment of the invention.

Referring to FIG. 1, there is shown a refrigerant circuit wherein a refrigerant compressor 1 (hereinafter referred to as a compressor) is connected through an outlet line 2 to a condenser 3 which has mounted in an outlet line 4 a throttle 5 for the refrigerant circuit. The throttle 5 is connected at its outlet side to an inlet line 6 of a receiver 7 having an outlet line 8 connected to a liquid header 9. A plurality of evaporators 10*a*, 10*b* and 10*c* (three in number as shown) are each connected at one end thereof to one of expansion valves 11*a*, 11*b* and 11*c* which have connected thereto check valves 12*a*, 12*b* and 12*c* in such a manner that each expansion valve and each check valve are connected in parallel with each other so as to permit the refrigerant in a liquid state to flow from the respective evaporator to the liquid header 9 through the respective check valve. The expansion valves 11*a*, 11*b* and 11*c* are connected through lines 13*a*, 13*b* and 13*c* to the liquid header 9 through electromagnetic valves 14*a*, 14*b* and 14*c*, respectively, which are connected in parallel with check valves 15*a*, 15*b* and 15*c* in such a manner that each electromagnetic valve and each check valve are connected in parallel with each other so as to permit the refrigerant in a liquid state to flow from the respective evaporator to the liquid header 9 through the respective check valve.

The evaporators 10*a*, 10*b* and 10*c* are connected at the other end thereof or the compressor side to flow passage change-over valves 17*a*, 17*b* and 17*c* through lines 16*a*, 16*b* and 16*c* respectively.

The outlet line 2 has connected thereto one end of a branch line 18 which is connected at the other end thereof to a high pressure gas header 19 which is connected through lines 20*a*, 20*b* and 20*c* respectively to the flow passage change-over valves 17*a*, 17*b* and 17*c*. The flow passage changer-over valves 17*a*, 17*b* and 17*c* are further connected through lines 21*a*, 21*b* and 21*c* to a sucked gas header 22 which is connected through a line 23 to an accumulator 24 which in turn is connected through a line 25 to the suction side of the compressor 1. A bypass line 26 having mounted therein a throttle 27 is connected at one end to a gas containing space in the upper portion of the receiver 7 and at the other end to the accumulator 24.

The receiver 7, which is a vessel for containing therein the refrigerant in the liquid state which is formed by the condensation of the refrigerant in a gaseous state in the condenser 3, is generally formed to have a volume large enough to collect therein all the refrigerant in the refrigerant circuit and still there is a space left for containing gas therein. The flow passage change-over valves 17*a*, 17*b* and 17*c* perform the function of switching between the lines connected to the evaporators 10*a*, 10*b* and 10*c* respectively. More specifically, they can interchangeably connect lines 16*a*, 16*b* and 16*c* to either lines 20*a*, 20*b* and 20*c* on the high pressure gas header side or to lines 21*a*, 21*b* and 21*c* on the sucked gas header side, respectively. As shown, flow passage change-over valve 17*a* connects line 16*a* to line 20*a*, and flow passage change-over valves 17*b* and 17*c* connect lines 16*b* and 16*c* to lines 21*b* and 21*c* respectively.

In FIG. 1, each of the three evaporators 10*a*, 10*b* and 10*c* represents unit evaporator means which, as described in the introductory part of the specification, may comprises either a single evaporator or a plurality of evaporators formed into one of a plurality of blocks in the circuit. For the sake of convenience of explanation, unit evaporator means comprise one of evaporators 10*a*, 10*b* and 10*c*.

Description will be given of the refrigerant circuit at the time the evaporators 10*a*, 10*b* and 10*c* all operate in the refrigerating mode. In this case, the flow passage change-over valves 17*a*, 17*b* and 17*c* are actuated to connect lines 16*a*, 16*b* and 16*c* to lines 21*a*, 21*b* and 21*c* respectively, the electromagnetic valves 14*a*, 14*b* and 14*c* are opened, and the throttle 27 in the bypass line 26 is closed. The throttle 5 in the main refrigerant circuit is opened. In operation, the refrigerant in a gaseous state which has had its pressure and temperature raised at the compressor 1 is supplied through outlet line 2 to the condenser 3 where the gas refrigerant gives off heat and changes to a liquid state. The refrigerant in the liquid state passes through the throttle 5 without having its pressure reduced and flows into the receiver 7 to collect therein. Then the liquid refrigerant flows from the receiver 7 through line 8 to the liquid header 9 where it branches into branch streams flowing through the electromagnetic valves 14*a*, 14*b* and 14*c* and lines 13*a*, 13*b* and 13*c* to be delivered to the expansion valves 11*a*, 11*b* and 11*c* which are disposed at the inlet to the evaporators 10*a*, 10*b* and 10*c* respectively. After having its pressure reduced at the expansion valves, the refrigerant in the liquid state absorbs heat at the evaporators 10*a*, 10*b* and 10*c* to perform a cooling operation and it vaporizes into the refrigerant in a gaseous state which is led through lines 16*a*, 16*b* and 16*c* to the flow passage change-over valves 17*a*, 17*b* and 17*c*. After passing through the flow passage valves, the gas refrigerant passes through lines 21*a*, 21*b* and 21*c* to be collected at the sucked gas header 22, and then flows into the accumulator 24, from which it is returned through the suction line 25 to the compressor 1 to complete the refrigeration cycle.

Now the operation of the refrigerating system according to the invention will be described when the system operates in the defrosting mode. Assume that one of the evaporators or evaporator 10*a* requires defrosting due to rather heavy frost formation as the refrigerating operation progresses. Upon frost being deposited on the surface of the evaporator 10*a* in an amount which exceeds a predetermined level, a sensing element (not shown) detects this phenomenon and generates a signal for closing the electromagnetic valve 14*a* which is associated with the evaporator 10, and the flow path change-over valve 17*a* is actuated and moved to a position shown in FIG. 1 in which it communicates the compressor side line 16*a* of the evaporator 10*a* to the line 20*a* leading to the high pressure gas header 19 for defrosting. Then the throttle 27 in the bypass line 26 is opened and the throttle 5 for the main refrigerant circuit has its opening closed to a suitable degree. Thus the superheated gas led to the high pressure gas header 19 through the branch line 18 flows into the evaporator 10*a* through line 20*a*, flow passage change-over valve 17*a* and line 16*a* to melt the frost deposited on the surface of the evaporator 10*a*. The refrigerant in the gaseous state changing to a liquid state in this process is led through check valve 12*a* to line 13*a* and flows onto the liquid header 9 through check valve 15*a*. When there is a large quantity of condensate, the refrigerant in the liquid state is returned through line 8 to the receiver 7 where it is combined with the refrigerant in a liquid state which flows from the condenser 3 through the throttle 5 to the receiver 7. A suitable quantity of liquid refrigerant returned to the receiver 7 from the evaporator 10*a* flows, together with the liquid refrigerant from the condenser 3, through the electromagnetic valves 14*b* and 14*c*, lines 13*b* and 13*c* and expansion valves 11*b* and 11*c* into the evaporators 10*b* and 10*c*, respectively, where the liquid refrigerant performs a cooling operation by absorbing heat and changes again into a gaseous state. The gas refrigerant flows through lines 16*b* and 16*c*, flow passage change-over valves 17*b* and 17*c* and lines 21*b* and 21*c*, respectively, into the sucked gas header 22 from which a stream of gas refrigerant is returned through the accumulator 24 and suction line 25 to the compressor 1.

When the liquid refrigerant produced by condensation of the gas refrigerant in the evaporator 10*a* by defrosting is small in quantity, the condensate or liquid refrigerant is combined at the liquid header 9 with the liquid refrigerant of the main refrigerant circuit which flows from the condenser 3 through the throttle 5, receiver 7 and line 8 into the liquid header 9. The combined liquid refrigerant flows in two streams into electromagnetic valves 14*b* and 14*c* from which it flows to the evaporators 10*b* and 10*c* as aforesaid.

In initial stages of the defrosting operation, the refrigerant in the liquid state changing from the gas liquid by condensation as the result of performing defrosting and flowing into the liquid header 9 is overcooled. This overcooled liquid refrigerant feeds the refrigerant containing flash gas and flowing into the liquid header 9 through the main refrigerant circuit to the evaporators 10*b* and 10*c* in a state of an overcooled liquid refrigerant. Thus no reduction is caused in the flow rate of refrigerant flowing through the evaporators 10*b* and 10*c*, so that the refrigerating system can perform refrigeration in a normal manner because the refrigerating ability of the evaporators is ensured.

The liquid refrigerant collected in the receiver 7 contains flash gas therein. In the receiver 7, the flash gas is separated from the liquid phase and collected in an upper portion of the receiver 7. In the defrosting mode, the throttle 27 in the bypass line 26 connecting the gas space in the upper portion of the receiver 7 to the accumulator 24 is open, so that the high pressure gas separated from the liquid refrigerant in the receiver 1 is released to the suction side of the compressor 1 through the low pressure end of the bypass line 26. Owing to the fact that the receiver 7 has a space which is large enough in volume to provide the gas space even if all the refrigerant in the refrigerant circuit is recovered and collected in the receiver 7, it is possible to positively collect in the receiver 7 the liquid refrigerant obtained by condensation of the gas refrigerant used for effecting defrosting, and at the same time flash gas is positively separated from the recovered liquid refrigerant and collected in the gas space in the upper portion of the receiver 7. Moreover, since the bypass line 26 opens in the gas space, it is possible to release only the flash gas to the suction side of the compressor 1. Accordingly, the compressor 1 has its suction pressure increased, thereby promoting the production of high pressure gas serving as a driving force for a defrosting operation and increasing the efficiency with which defrosting is effected.

The heat for effecting defrosting is provided by the heat absorbed by the evaporators 10*b* and 10*c* performing a refrigerating operation and the heat given to the refrigerant by the compressing action of the compressor 1. Also, the release of the flash gas from the receiver 7 positively produces pressure differential between positions anterior and posterior to the throttle 5 of the main refrigerant circuit, so that the liquid refrigerant obtained by condensation of the gas refrigerant which has performed the defrosting operation can be readily forced into the receiver 7 by this differential pressure. This enables defrosting to be performed quickly. Moreover, when the refrigerating system is switched from the defrosting mode to the refrigerating mode, no refrigerant in the liquid state is returned to the compressor and the system can operate in a stable fashion.

The description set forth hereinabove refers to a defrosting operation performed with regard to the evaporator 10*a*. It is to be understood that the same operation is performed when defrosting of other evaporators 10*b* and 10*c* is effected.

Figure 2:
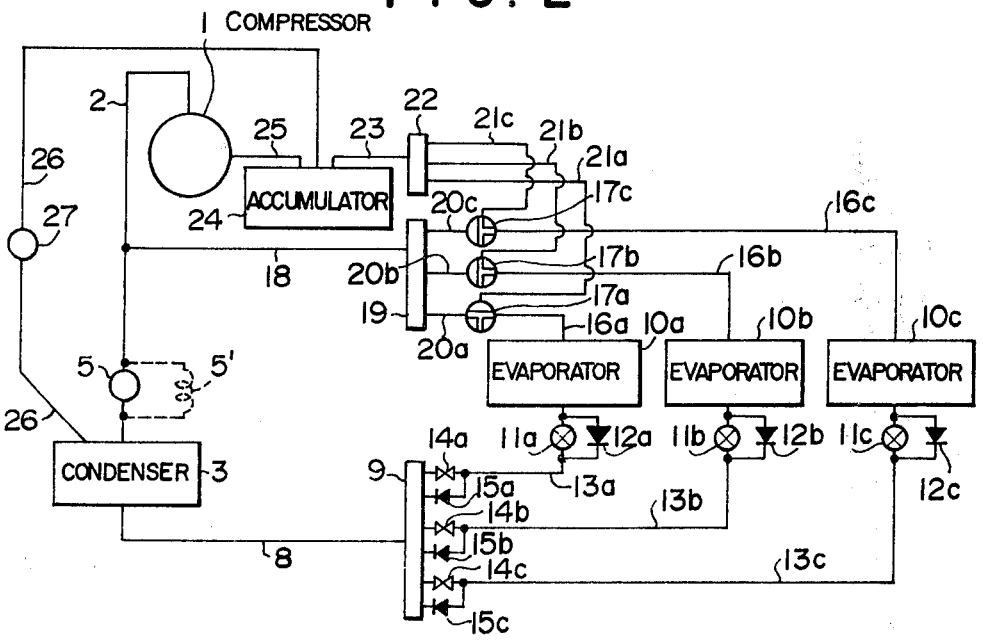
FIG. 2 is a diagram showing the refrigerant circuit of a refrigerating system having no receiver, which system comprises another embodiment of the invention.

FIG. 2 shows a refrigerating system of the type which has no receiver. In this embodiment of the invention, the condenser is of the type which, like a water-coooled type condenser, has a liquid refrigerant reservoir of a large volume. In this embodiment, the throttle 5 for the main refrigerant circuit is mounted between the compressor 1 and the condenser 3 of the aforesaid type, the branch line 18 branches off at a point in the outlet line 2 of the compressor 1 between the compressor 1 and the throttle 5, the outlet side of the condenser 3 is connected through line 8 to the liquid header 9, the bypass line 26 connects the gas space in the upper portion of the condenser 3 to the suction side of the compressor (the upper portion of the accumulator 24 in this embodiment) and mounts therein the throttle 27, and no receiver is mounted. The construction of other parts including the valves and lines and the operation thereof are similar to those described with reference to the embodiment shown in FIG. 1. In the two drawings, like reference characters designate similar parts and their description is omitted.

When the system operates in the refrigerating mode wherein all the evaporators 10*a*, 10*b* and 10*c* perform refrigeration, the refrigerant circuit operates in the same manner as that of the embodiment shown in FIG. 1 except that the refrigerant in a liquid state obtained by condensation of the gas refrigerant at the condenser 3 is stored temporarily in the condenser 3 itself and then flows into the liquid header 9 through line 8. Operation of the other parts is similar to that of the parts of the embodiment shown in FIG. 1, so that the description of the operation is omitted.

The operation of the embodiment shown in FIG. 2 when it operates in the defrosting mode will now be described. Assume that frost has been deposited on the surface of the evaporator 10*a* and defrosting thereof must be performed. The electromagnetic valve 14*a*, flow passage change-over valve 17*a*, throttle 5 of the main refrigerant circuit and throttle 27 of the bypass line 26 are manipulated as described with reference to the embodiment shown in FIG. 1. As a result, the high pressure gas refrigerant led from the outlet line 2 of the compressor 1 through the branch line 18 to the high pressure gas header 19 flows through the flow passage change-over valve 17*a* and line 16*a* into the evaporator 10*a* where it melts the frost deposited on the surface thereof. The refrigerant in the gaseous state is condensed and changes back into a liquid state and flows through check valve 12*a*, line 13*a* and check valve 15*a* into the liquid header 9. When the liquid refrigerant is large in quantity, it flows through line 8 to be recovered in the condenser 3 where it is combined with the liquid refrigerant flowing through the main refrigerant circuit. At the same time, a suitable quantity of liquid refrigerant flows in two streams from the liquid header 9 through the electromagnetic valves 14*b* and 14*c* into the evaporators 10*b* and 10*c* respectively. When the liquid refrigerant obtained by condensation of the gas refrigerant changing into a liquid state as the result of performing defrosting is small in quantity, the liquid refrigerant is combined at the liquid header 9 with the liquid refrigerant flowing through the main refrigerant circuit, and the combined liquid refrigerant flows in two streams into the electromagnetic valves 14*b* and 14*c*.

The liquid refrigerant recovered in the condenser 3 has its flash gas separated from the liquid phase, the separated flash gas being released from the low pressure end of the bypass line 26 to the suction side of the compressor 1, so that the suction pressure of the compressor 1 is increased and the high pressure gas refrigerant can be produced for effecting defrosting. The release of the flash gas positively produced pressure differential between positions anterior and posterior to the throttle 5 of the main refrigerant circuit or between the branch line 18 and the condenser 3, so that the liquid refrigerant obtained by condensation of the gas refrigerant that has performed defrosting can be readily forced by this differential pressure into the condenser 3.

As aforesaid, the embodiment shown in FIG. 2 operates in the same manner as the embodiment shown in FIG. 1, and the condenser 3 performs the same function as the receiver 7 of FIG. 1 with excellent results.

Generally, the branch line 18 for taking out the high pressure gas refrigerant for effecting defrosting is connected to the outlet line 2 of the compressor 1 as shown in the embodiments of FIGS. 1 and 2. However, when this arrangement is used, exhaust gas of 80° C to 120° C may flow directly through the branch line 18 into the evaporator for which defrosting is desired to be effected when the system operates in the defrosting mode, thereby causing local heat distortion on the respective flow passage change-over valve and the evaporator or causing sublimation of the frost.

Heat distortion may have disadvantages in that the contact heat resistance between the pipe and fins of an evaporator of the cross-fin tube type is increased with time, the pipes and the wells develop crack formation, and adverse effects are exerted by heat distortion on the expansion valves. Also, the sublimation of the frost due to sudden inflow of the gas refrigerant of elevated temperatures may have the danger of turning the removed frost into a latent heat load in the refrigerating operation of the system to be continuously performed following the defrosting operation. Moreover, when the evaporators are mounted in a showcase, the air curtain of the show case will become foggy or the acrylic plates or mirrors used for providing interior decoration will become dim with vapor.

Figure 3:
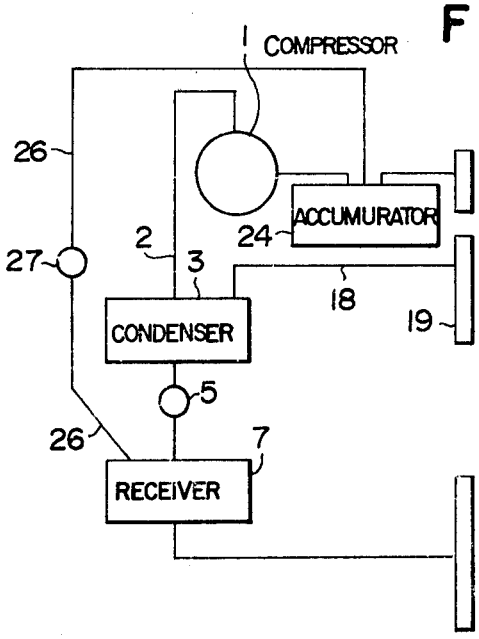
FIG. 3 is a fragmentary diagram showing a modified form of branch line of the refrigerant circuit of a refrigerating system having a receiver.

When it is necessary to take measures to cope with this situation, a branch line 18′ may be connected to the upper portion of the condenser 3 or the high pressure gas space thereof which is remoted from the high pressure gas inlet portion (the connection between the outlet line 2 of the compressor 1 and the condenser 3) as shown in FIG. 3, in case the condenser used in the embodiment shown in FIG. 1 is of the water-cooled type. By this arrangement, it is possible to reduce the temperature of the high pressure gas taken out through the branch line 18′ and delivered to the evaporator for effecting defrosting by several scores of degree centigrade as compared with the temperature of the discharged gas.

However, when the condenser used is of a construction which has no reservoir for the gas, such as a condenser of the air-cooled by using a heat exchanger of the cross-fin tube type or a condenser or the water-cooled type which uses a double-tube type heat exchanger, it is impossible to connect the branch line to the condenser, and consequently the branch line should be connected to the outlet line of the compressor. Also, in the embodiment shown in FIG. 2, the branch line 18 should be connected to the inflow side of the throttle 5. Thus, the branch line 18 should be connected to the outlet line 2 of the compressor 1.

Figure 4:
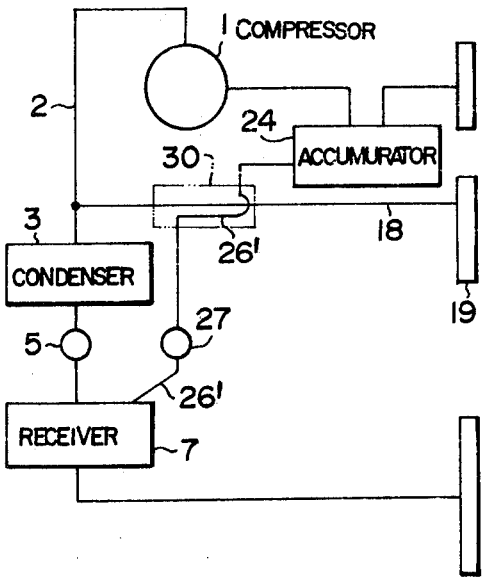
FIG. 4 is a fragmentary diagram showing a modified form of branch line and a modified form of bypass line of the refrigerant circuit of a refrigerating system having a receiver.
Figure 5:
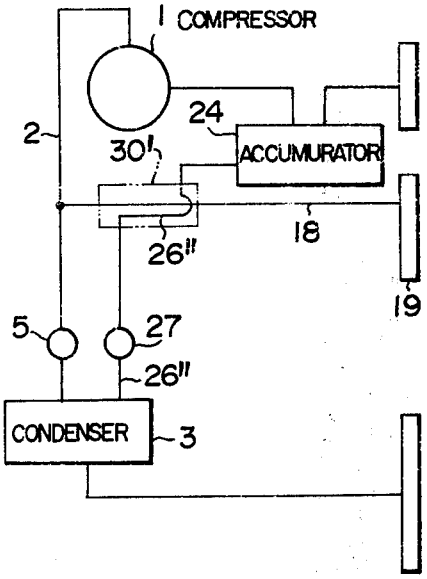
FIG. 5 is a fragmentary diagram showing a modified form of branch line and a modified form of bypass line of the refrigerant circuit of a refrigerating system having no receiver.

In the condenser of the aforesaid construction, one has only to provide means for converting the high pressure gas for effecting defrosting into gas of a relatively low temperature before flowing into the evaporator in which defrosting is desired to be effected. FIGS. 4 and 5 show alternative arrangements of the branch line and the bypass line adapted to accomplish this object.

The arrangement shown in FIG. 4 is adaptable for use in the embodiment shown in FIG. 1. In this arrangement, the branch line 18 connecting the outlet line 2 of the compressor 1 to the high pressure gas header 19 and the bypass line 26′ connecting the upper portion of the receiver 7 to the suction side of the compressor 1 and having the throttle 27 mounted therein are arranged in heat exchanging relation. That is, as shown, a portion of the branch line 18 and a portion of the bypass line 26′ from the throttle 27 to the accumulator 24 are located in contacting relation as shown at 30. Other parts of the system are as shown in FIG. 1 and the description of their construction and operation is omitted.

When this arrangement of the bypass line and the branch line is used, the high pressure gas of elevated temperatures flowing through the branch line 18, high pressure gas header 19 and flow passage changeover valve to the evaporator in which defrosting is desired to be effected in the defrosting mode exchanges heat at the line portions 30 with the gas refrigerant of low temperature flowing through the bypass line 26′ to the accumulator 24 which gas refrigerant flows from the upper portion of the receiver 7 into the bypass line 26′ where it has its pressure and temperature reduced by the throttle 27. Thus the high pressure gas of elevated temperatures flowing through the branch line 18 is cooled into a substantially saturated gas (about 30° to 50° C) for introduction into the desired evaporator.

The major portion of the heat for effecting defrosting is in the form of latent heat produced by condensation of the gas refrigerant, so that there is no danger of a reduction in defrosting performance.

For causing the two streams of refrigerant flowing through the branch line 18 and bypass line 26′ to effect heat exchange therebetween, portions of the two lines of a suitable length may be brought into contact with each other as illustrated. Alternatively, the two lines may be formed into a heat exchanger of the double-line heat exchanger (not shown). The heat exchanging portion (contacting line portion) of the bypass line 26′ may be located between the throttle 27 and the receiver 7.

Additionally, if it is impossible to reduce the temperature of the high pressure gas sufficiently to avoid the influences of heat distrotion by merely transferring the heat of the high pressure gas used for defrosting to the gas flowing from the upper portion of the receiver 3, means may be provided for sucking a portion of the liquid refrigerant into the bypass line 26 from the receiver 7.

The arrangement of the bypass line and the branch line shown in FIG. 5 is adaptable for use in the embodiment of the refrigerating system in conformity with the invention, wherein the branch line 18 connecting the outlet line 2 of the compressor 1 at a point posterior to the throttle 5 to the high pressure gas header 19 and the bypass line 26″ connecting the upper portion of the condenser 3 to the accumulator 24 through the throttle 27 are arranged in heat exchanging relation by bringing portions of these lines into contact with each other as shown at 30′.

By this arrangement, the heat of the high pressure gas of elevated temperatures flowing through the branch line 18 for effecting defrosting is transferred through the contacting line portions 30″ to the gas refrigerant of low temperature. The result of this is that the high pressure gas of elevated temperatures is cooled to a substantially saturated gas before flowing into the evaporator. Like the embodiment shown in FIG. 2, the embodiment shown in FIG. 1 may use other heat exchanging means and the description thereof is omitted.

When the modified arrangement of the branch line or the branch line and the bypass line illustrated in FIGS. 3, 4 or 5 is incorporated in the refrigerating system according to the invention, the following advantage can be offered. It is possible to eliminate the occurrence of local heat distortion caused by the high pressure gas of elevated temperatures for effecting defrosting thereby avoiding an increase with time of the contact heat resistance between the pipe and fins of an evaporator of the cross-fin tube type and preventing crack formation at the welds. No sublimation of the frost is caused, and consequently no adverse effects are exerted on the flow passage change-over valves. Moreover, since the major portion of the heat used for effecting defrosting is in the form of latent heat due to condensation of the gas refrigerant, defrosting performance of the system can be increased.

The throttle 27 mounted in the bypass line 26 may be in any form as desired, such as an electromagnetic valve, a series circuit of an electromagnetic valve and a capillary tube, a series circuit of an electromagnetic valve and a suction pressure control valve or a combination of these means. Any type of throttle may be used depending on the construction of the refrigerant circuit.

The lower pressure end of the bypass line 26 may be connected to the sucked gas header 22 or any other line of low pressure, besides the accumulator 24 as shown.

The throttle 5 for the main refrigerant circuit may use an electromagnetic valve, pressure control valve, etc. If an electromagnetic valve is used, the throttle 5 is opened when the system operates in the refrigerating mode and closed in the defrosting mode. Therefore, when the number of evaporators operating in the defrosting mode is small, a sufficient quantity of liquid refrigerant to enable the evaporators to continue in the refrigerating operation can be supplied to the evaporators 10*b* and 10*c* by using the liquid refrigerant produced by defrosting plus the liquid refrigerant remaining in the receiver 7 in the embodiment of FIG. 1 and the liquid refrigerant remaining in the condenser 3 in the embodiment of FIG. 2. However, when the number of evaporators operating in the refrigerating mode is large, the amount of the liquid refrigerant supplied to the evaporators 10*b* and 10*c* continuing in the refrigerating operation will be reduced. The reason for this is that, since the throttle 5 is closed, the liquid refrigerant in the condenser 3 does not flow to the receiver 7 in the embodiment illustrated in FIG. 1. In the embodiment illustrated in FIG. 2, the pressure of high pressure gas is abnormally increased because the high pressure gas does not flow to the condenser, thereby causing the paucity of the liquid refrigerant.

To prevent the occurrence of the aforesaid phenomenon, a capillary tube 5' shown in broken lines in FIGS. 1 and 2 may be provided in a manner to be disposed in parallel with the electromagnetic valve. In the embodiment illustrated in FIG. 1, the liquid refrigerant collecting in the condenser 3 may be allowed to flow suitably to the receiver 7 through the capillary tube 5', and in the embodiment illustrated in FIG. 2, the high pressure gas may be allowed to suitably flow to the condenser 3. It goes without saying that the differential pressure necessary for effecting defrosting can be provided by the closure of such electromagnetic valve. In case the throttle 5 is in the form of a high pressure control valve, a reduction in high pressure at the time the system operates in the defrosting mode produces the effect of throttled differential pressure. In the embodiment illustrated in FIG. 1, the high pressure control valve is suitably opened to allow the liquid refrigerant to flow out as the high pressure increases, even if the number of evaporators performing a refrigerating operation is large and the liquid collects in the condenser 3. As a result, no abnormal rise in high pressure is produced. In the embodiment illustrated in FIG. 2, the high pressure control valve is suitably opened to permit the condenser 3 to perform a condensing action as the pressure increases, in the event that the number of evaporators is large and the high pressure is increased. Thus no abnormal increase in high pressure is produced.

A pressure loss which may occur at the high pressure control valve when the system operates in the refrigerating mode can be reduced to a level not higher than 0.1 $kg/cm^2$. In the event that the pressure loss is great and there is the danger of production of flash gas in the liquid line, an electromagnetic valve may be connected in parallel with the high pressure control valve, with the electromagnetic valve being opened when the system operates in the refrigerating mode.

The aforesaid description applies to the throttle 5 in the form of a float valve in the embodiment illustrated in FIG. 1. In this case, when the number of evaporators performing refrigeration is small, the condensing capability of the evaporator in which defrosting is effected is large, so that substantially no liquid refrigerant collects in the condenser 3, with a result that the float valve remains closed to provide differential pressure necessary for enabling the defrosting of the evaporator to be performed. Even when the number of evaporators is large, the liquid refrigerant collecting in the condenser 3 flows to the receiver 7 through the float valve, thereby ensuring that differential pressure necessary for effecting defrosting is obtained. The aforesaid equipment may be used as the throttle 5 for the main refrigerant circuit depending on the construction of the refrigerant circuit. In any case, the throttle 5 should be of a construction such that it performs no reduction in the pressure of the refrigerant when the refrigerating system operates in the refrigerating mode.

Figure 6:
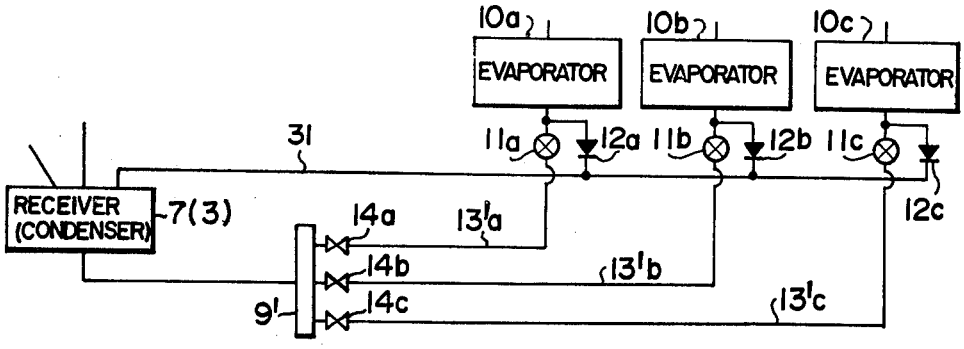
FIG. 6 is a fragmentary diagram showing a modification of the expansion valve side line of the refrigerant circuit.
Figure 7:
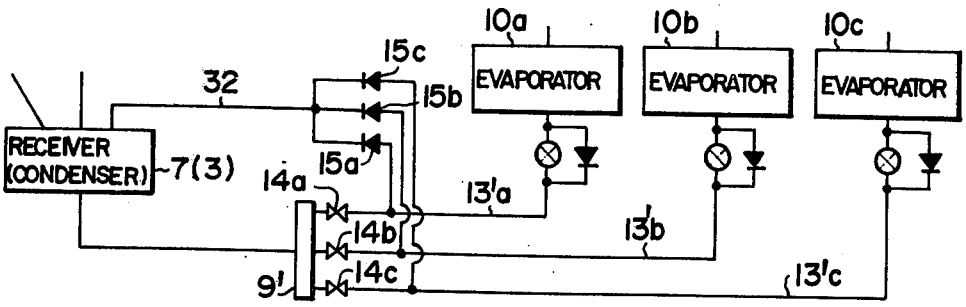
FIG. 7 is a fragmentary diagram showing a further modification of the expansion valve side line of the refrigerant circuit.
Figure 8:
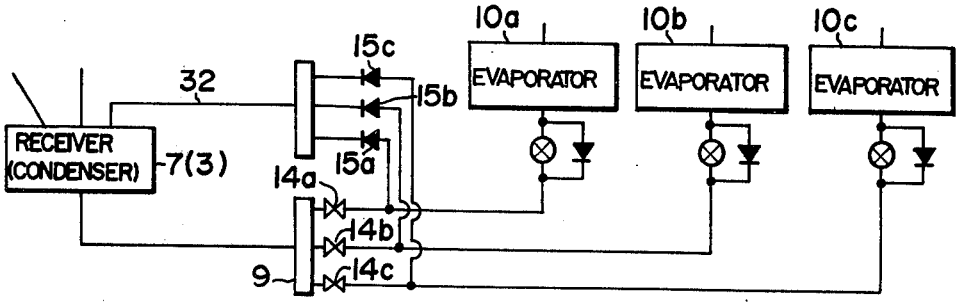
FIG. 8 is a fragmentary diagram showing a still further modification of the expansion valve side line of the refrigerant circuit.

The refrigerant in the liquid state produced by condensation of the refrigerant in the gaseous state in the evaporator in which defrosting has been effected may be returned to the condenser 3 or receiver 7 without passing the liquid refrigerant through the liquid header 9 as shown in FIGS. 1 and 2. An alternative arrangement for returning the liquid refrigerant is shown in FIG. 6 wherein the check valves 12*a*, 12*b* and 12*c* are each connected at the outlet side thereof through a line 31 to the receiver 7 (in the embodiment of FIG. 1) or the condenser 3 (in the embodiment of FIG. 2) to directly return the liquid refrigerant thereto, and the liquid header 9' handles only the liquid refrigerant flowing to the electromagnetic valves 14*a*, 14*b* and 14*c*. FIG. 7 shows another alternative arrangement in which the liquid header 9' handles only the liquid refrigerant flowing to the electromagnetic valves 14*a*, 14*b* and 14*c*, and the check valves 15*a*, 15*b* and 15*c* are each connected at the outlet side thereof to the receiver 7 or condenser 3 through a line 32. FIG. 8 shows still another alternative arrangement in which a return condensate header 9'' is mounted separately from the liquid header 9' for introducing the liquid refrigerant into the electromagnetic valves 14*a*, 14*b* and 14*c*, such condensate return header 9'' being connected to the outlet side of each of the check valves 15*a*, 15*b* and 15*c* to return the condensate through the line 32 to the receiver 7 or condenser 3.

By the arrangement shown in FIG. 6, 7 or 8, the refrigerant in the liquid state produced by condensation of the refrigerant in the gaseous state which has effected defrosting can be positively returned to the receiver 7 or the liquid reservoir in the condenser 3, and the flash gas incorporated in the liquid refrigerant can be positively separated from the liquid refrigerant and released through the lower pressure end of the bypass line. Thus the refrigerant in the liquid state which has flash gas incorporated therein is prevented from being supplied to the evaporators performing a refrigerating operation. Accordingly, it is possible to ensure that the evaporators performing a refrigerating operation while the system is operating in the defrosting mode perform their refrigerating function satisfactorily, and no reduction in pressure is caused to occur on the suction side of the compressor.

We claim:

1. A refrigerating system comprising a refrigerant compressor, a condenser, a reservoir for a condensate, a plurality of unit evaporator means, a plurality of expansion valves each located on the condenser side of one of said unit evaporator means and connected in parallel with a check valve, a plurality of electromagnetic valves each located in a line connecting one of said expansion valves to said reservoir for a condensate and connected in parallel with a check valve, a branch line connected at one end thereof to an outlet line of said compressor, and a plurality of flow passage changeover valves each located on the compressor side of one of said unit evaporator means and interchangeably connecting the respective unit evaporator means either to the suction side of said compressor or to the other end of said branch line, said electromagnetic valves being opened and said unit evaporator means being all connected to the suction side of said compressor when the refrigerating system operates in a refrigerating mode and any of the unit evaporator means desired to be defrosted being connected to the other end of said branch line through the associated flow passage changeover valve and the electromagnetic valve belonging to said unit evaporator means in which defrosting is performed being closed when the refrigerating system operates in a defrosting mode, wherein the improvement comprises:

a throttle means for a main refrigerant circuit located in a line of said main circuit connecting said compressor to said reservoir for a condensate in a position downstream of a point of joining of said branch line and said outlet line of said compressor; and a bypass line connecting an upper portion of said reservoir for a condensate to the suction side of said compressor and mounting therein a throttle means for the bypass line;

said throttle means for the bypass line being closed and said throttle means for the main refrigerant circuit being opened when the refrigerating system operates in the refrigerating mode;

each of said unit evaporator means in which defrosting is desired to be effected being connected directly to said reservoir for a condensate by bypassing the associated expansion valve, the throttle valve means for the main refrigerant circuit having its degree of opening suitably reduced so as to throttle the flow therethrough of the refrigerant and said throttle means for the bypass line being opened when the refrigerating system operates in the defrosting mode.

2. A refrigerating system as set forth in claim 1, wherein said reservoir for a condensate comprises a receiver, and said throttle means for the main refrigerant circuit is interposed between said condenser and said receiver.

3. A refrigerating system as set forth in claim 1, wherein said reservoir for a condensate is provided in said condenser, and said throttle means for the main refrigerant circuit is located in an inlet line of the condenser.

4. A refrigerating system as set forth in claim 2, wherein said one end of said branch line is located in a position remote from a high pressure gas inlet portion in an upper part of said condenser.

5. A refrigerating system as set forth in claim 1, wherein said branch line and said bypass line are arranged in heat exchanging relationship.

6. A refrigerating system a set forth in claim 5, wherein said branch line and said bypass line are located in a manner to contact each other.

7. A refrigerating system as set forth in claim 5, wherein said branch line and said bypass line arranged in heat exchanging relationship are formed as a heat exchanger of the double-line type.

8. A refrigerating system as set forth in claim 1, wherein a line extending from each of said unit evaporator means and mounting therein the associated expansion valve is separated into two lines, one line being operative to feed the refrigerant from the reservoir for a condensate to each unit evaporator means and the other line being operative to release the refrigerant from each unit evaporator means to the reservoir for a condensate.

9. A refrigerating system as set forth in claim 8, wherein the line operative to release the refrigerant from each unit evaporator means to the reservoir for a condensate is a line directly connecting the outlet side of the check valve connected in parallel with each expansion valve to the reservoir for a condensate.

10. A refrigerating system as set forth in claim 8, wherein said line operative to feed the refrigerant to each unit evaporator means is a line mounting therein the associated electromagnetic valve, and said line operative to release the refrigerant to the reservoir is a line mounting therein the associated check valve.

11. A refrigerating system as set forth in claim 1, wherein said throttle means for the main refrigerant circuit comprises an electromagnetic valve.

12. A refrigerating system as set forth in claim 1, wherein said throttle means for the main refrigerant circuit comprises a high pressure control valve.

13. A refrigerating system as set forth in claim 1, wherein said throttle means for the main refrigerant circuit comprises an electromagnetic valve and a capillary tube connected in parallel with each other.

14. A refrigerating system as set forth in claim 1, wherein said throttle means for the main refrigerant circuit comprises an electromagnetic valve and a high pressure control valve connected in parallel with each other.

15. A refrigerating system as set forth in claim 2, wherein said throttle means for the main refrigerant circuit comprises a float valve.

16. A refrigerating system as set forth in claim 1, wherein said throttle means for the bypass line comprises an electromagnetic valve.

17. A refrigerating system as set forth in claim 1, wherein said throttle means for the bypass line comprises an electromagnetic valve and a capillary tube connected in series with each other.

18. A refrigerating system as set forth in claim 1, wherein said throttle means for the bypass line comprises an electromagnetic valve and a suction pressure control valve connected in series with each other.

* * * * *